US006245958B1

(12) United States Patent
Morse et al.

(10) Patent No.: US 6,245,958 B1
(45) Date of Patent: Jun. 12, 2001

(54) METHODS FOR NON-INCENDIARY DISPOSAL OF ROCKETS, PROJECTILES, MISSILES AND PARTS THEREOF

(75) Inventors: Robert S. Morse, Cypress, TX (US); Peter A. Berardo, Mammoth Lakes, CA (US); Gilbert H. Lovell, III, Baltimore, MD (US); Victor H. Edwards, The Woodlands, TX (US); Chris Neil Amos, Columbia, MD (US); D. Scott Williams, Aberdeen, MD (US); Dennis W. Baker, Arnold, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 08/928,581

(22) Filed: Sep. 12, 1997

(51) Int. Cl.[7] ..... B09B 3/00; B09B 5/00
(52) U.S. Cl. ..... 588/202; 588/203
(58) Field of Search ..... 588/202, 203; 149/124; 134/22.1, 22.12, 22.13, 167 R, 22.11, 166 R

(56) References Cited

U.S. PATENT DOCUMENTS

| | | | | |
|---|---|---|---|---|
| 1,492,924 | * | 5/1924 | Knight | 134/167 R |
| 3,440,098 | * | 4/1969 | Scott | 134/167 R |
| 4,111,490 | * | 9/1978 | Liesveld | 299/17 |
| 5,368,433 | * | 11/1994 | Seyffert | 414/412 |
| 5,516,970 | * | 5/1996 | Miller et al. | 588/202 |
| 5,516,971 | * | 5/1996 | Hurley | 588/203 |
| 5,574,203 | * | 11/1996 | Noel et al. | 588/203 |
| 5,737,709 | * | 4/1998 | Getty et al. | 588/202 |
| 5,901,759 | * | 5/1999 | Nickens et al. | 141/51 |

FOREIGN PATENT DOCUMENTS

3940567 * 12/1989 (DE) ..... 588/202

OTHER PUBLICATIONS

Barass, R.C., Alternative Technologies for the Destruction of Chemical Agents and Munitions, p. 73, 1993.*

Yang, Yu–Chu, Chemical reactions for neutralizing chemical warfare agents, Chemistry and Industry, p. 334–337, May 1995.*

Sidhoum, Mohammed et al., Enhanced alkaline hydrolysis and biodegradability of nitrocellulose bearing missile propellant, NASA Conference Publication, p. 87–98.*

* cited by examiner

*Primary Examiner*—Steven P. Griffin
*Assistant Examiner*—Eileen E. Nave
(74) *Attorney, Agent, or Firm*—Arthur L. Plevy; Buchanan Ingersoll PC

(57) ABSTRACT

There is disclosed a method and apparatus for non-incendiary disposal of rockets, projectiles, missiles and similar devices and parts thereof. The method and apparatus employs a series of steps whereby a rocket is sheared into sections where the sections or pieces are then directed to baskets which hold the pieces and which baskets are transferred through a hydrolyzing solution and remain in the hydrolyzing solution for a sufficient period to enable decontamination of both the rocket parts as well as propellant to residual agents. The process involves pushing the basket along an output channel where various parts are transferred to the basket through controlled blast doors. In other instances, such explosive devices such as bursters are handled in a similar manner by exposing the bursting agents to caustic baths while controlling the rate of caustic flow to assure decontamination of all such parts.

12 Claims, 9 Drawing Sheets

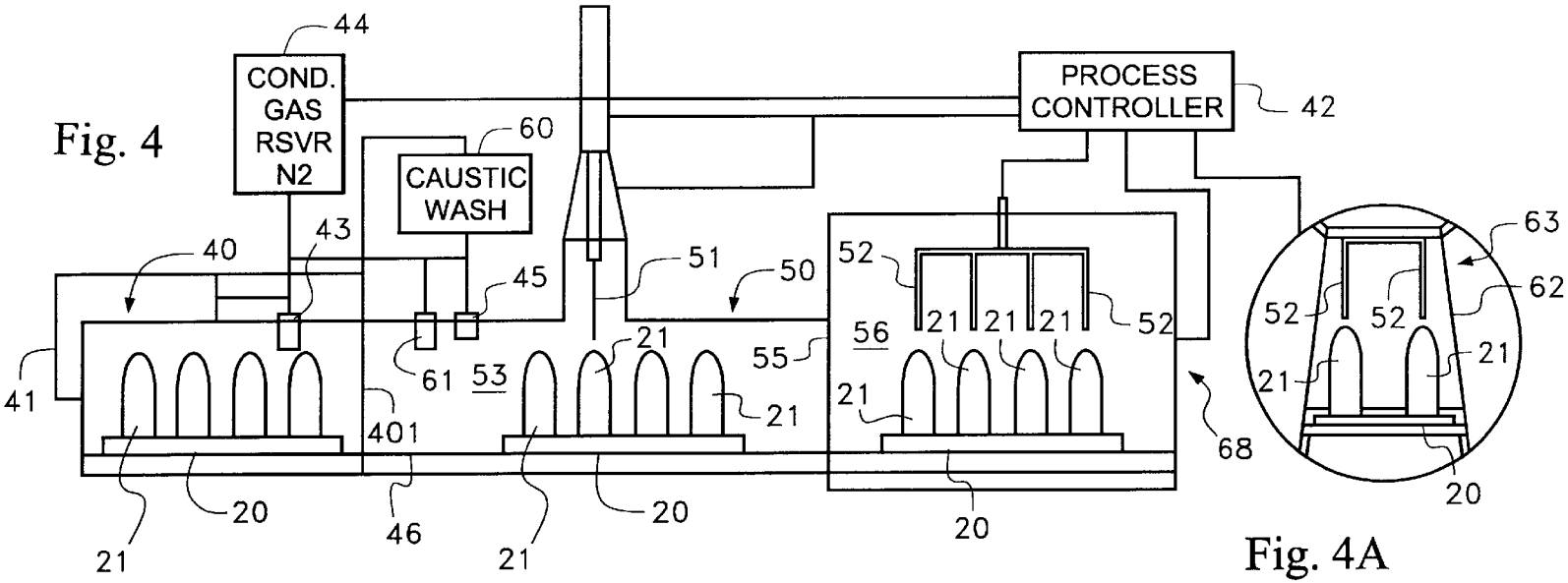
Fig. 4
Fig. 4A
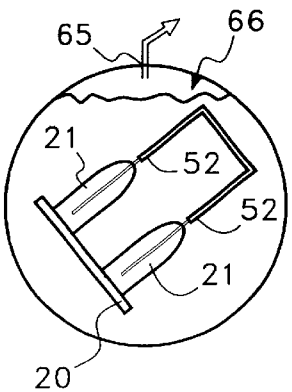
Fig. 4D
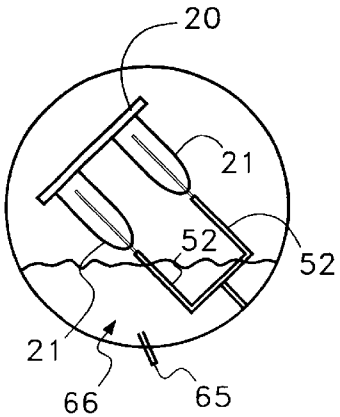
Fig. 4C
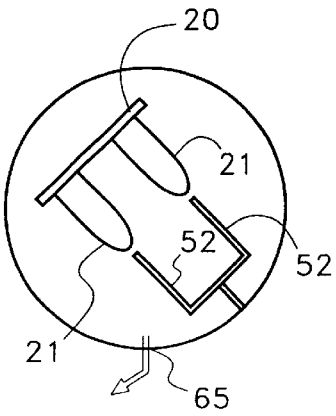
Fig. 4B

METHODS FOR NON-INCENDIARY DISPOSAL OF ROCKETS, PROJECTILES, MISSILES AND PARTS THEREOF

FIELD OF THE INVENTION

This invention relates to methods and apparatus for the non-incendiary disposal of rockets, missiles, and projectiles, and more particularly, to techniques for disassembling and disposing of rocket parts containing deleterious substances such as propulsion fuels and so on.

BACKGROUND OF THE INVENTION

As one can ascertain, with the stockpiling of rockets, missiles, and other highly dangerous projectiles, there is a need to provide means to adequately dispose of such items. Particularly, in the present due to the cooling off of the Cold War and based on the division of the Soviet Union, there has been a need to dispose of large numbers of rockets and other projectiles in order to decrease the stockpiles and to reduce the apparent danger inherent in storing and stockpiling large numbers of these devices.

An obvious technique for destroying such devices is by incinerating or blowing up such devices. As is well known, this is inherently and extremely dangerous. It is a fact that explosions of this sort are relatively uncontrollable. If they are done in a controlled environment, then excessive amounts of materials, devices and cost have to be employed to assure public safety as well as the safety of all individuals in conducting such operations. Hence, the destruction of such devices by incendiary techniques is inadvisable and extremely dangerous.

There are other techniques for getting rid of such missiles, such as submerging them or burying them, all of which create pollution problems and are generally detrimental to the environment.

It is therefore an object of the present invention to provide techniques for the non-incendiary disposal of projectiles, rockets, missiles and parts thereof. As will be explained, such techniques involve the disassembly of such devices and the neutralization of various exposed parts after disassembly, as well the total obliteration of the entire device body and frame, utilizing non-incendiary techniques.

SUMMARY OF THE INVENTION

The present invention describes a method of disposing of projectiles, missiles, rockets and devices containing chemical or other energetic incendiary explosive materials to render such devices harmless by a non-incendiary process, comprising the steps of hydrolyzing said device with a caustic solution for a period sufficient to render said energetic, incendiary explosive materials harmless including all parts of said devices in contact with said materials.

BRIEF DESCRIPTION OF THE DRAWINGS

FIG. 4 is a process diagram showing the process and apparatus used to hydrolyze projectiles by removing the agents from such projectiles.

FIGS. 4*a–d* shown various rotational positions of the apparatus used during hydrolyzation.

DETAILED DESCRIPTION OF THE INVENTION

Figure 1:
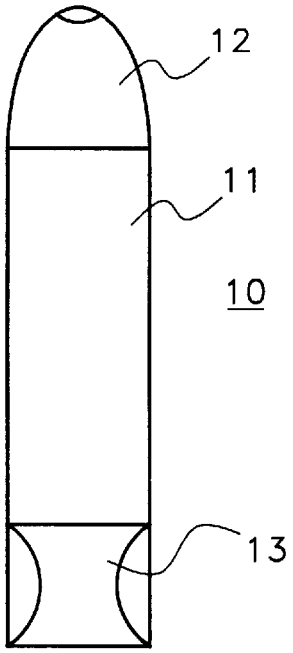
FIG. 1 is a diagrammatic view of a rocket assembly useful in explaining this invention.

Referring to FIG. 1 there is shown a simple diagram of a typical rocket assembly 10. As one can ascertain, rockets have been known for centuries and they were originally attributed to use by the Chinese following close after the invention of gunpowder. Many modem day rockets which have been used both in military and for other purposes utilize chemical propellants. Such a rocket utilizes chemicals which produce hot gases under high pressure. These are produced in a combustion chamber and enable the rocket to acquire its velocity through an output nozzle. Rockets of this class can be subdivided into solid propellant, liquid propellant, and hybrid rockets which basically use solid and liquid fuels.

The rocket normally contains at the front end designated by numeral 12, a payload, a war head, and a fuze for igniting the same. Rockets also contain propellants and agents for operation. In the case of a solid propellant rocket, the propellant consists of the combustibles and an agent for supplying the oxygen for combustion. These rockets may have a variety of surface configurations and arrangements. The propellant and oxygen are introduced into the combustion chamber 11 where they burn. In doing so, it produces a hot, high pressure gas which is discharged through a nozzle and motor 13, and thus, produces the thrust that propels the rocket.

In liquid propellant rockets, the liquid combustibles are contained in tanks and are fed into the combustion chamber through an injector head by a propellant supply system. As indicated, the chemicals used, as well as the propellants used, are extremely toxic. Apart from being toxic, they produce toxic gases and chemicals when they are subjected to combustion or ignition. For example, certain liquid rockets employ methyl nitrate and potassium permanganate. Other liquid propellants employ kerosene, hydrazene, hydrogen, as well as ammonia, and so on.

Solid propellants are basically powder packed squibs, the charge being a mix of dry fuel and a dry, oxygen-rich chemical such as a mixture of polyisobutene and ammonium perchlorate. These rockets are simple and reliable but possess a lower thrust and are relatively heavy because of the combustion chamber which constitutes the majority weight of the rocket. In FIG. 1, the combustion chamber is shown generally, while the nose 12 contains highly explosive materials as well as the burster for generation of the explosion in a rocket weapon.

While the above-noted discussion concerns chemical types of rockets, it is understood that the techniques to be described for the non-incendiary disposal of rockets relate in general to all types of rocket structures, as well as projectiles, missiles and other explosive devices.

Figure 2:
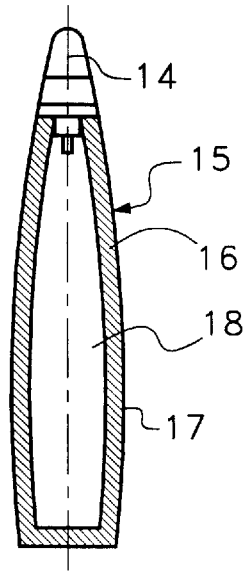
FIG. 2 is a sectional view of a projectile which can be employed in conjunction with this invention.

Referring to FIG. 2 there is shown a simple diagram of a projectile. The projectile is typically fired from a gun, cannon, etc. and is designed to enable a favorable ballistic trajectory. The typical projectile shown in FIG. 2 has a tapered point which is called the ogive which is joined to a cylindrical portion 17. The ogive usually contains a fuze 14 for detonating the bursting charge 16 of the shell. At the transition from the ogive to the cylindrical part is an accurately machined band called a bourrelet which is depicted by reference numeral 18.

As one understands, the configuration shown in FIG. 2 is by way of example only, and the projectile 15 can take many alternate forms. It is also indicated that the top portion 12 of the rocket of FIG. 1 is a projectile and contains for example, a fuze and a burster which eventually ignites the payload which may be a high explosive material such as TNT (Trinitrotoluene), RDX (cyclotrimethyl enetrinitramine), HMX (Cyclotetramethylenetetramine), Tetryl (N-methyl-N, 2,4,6-tetranitro benzamine) and so on.

Different projectiles, as well as different rockets, are well-known in the prior art and, the techniques to be described are applicable to the disposal of all such devices and materials. In general, the fuze 14 associated with the projectile which also would be associated with the rocket is a device for detonating the explosive charge in a shell, missile, mine or bomb. As one will understand, there are many different types of fuzes which can be utilized in conjunction with projectiles and rockets. Such devices are well known.

Figure 3:
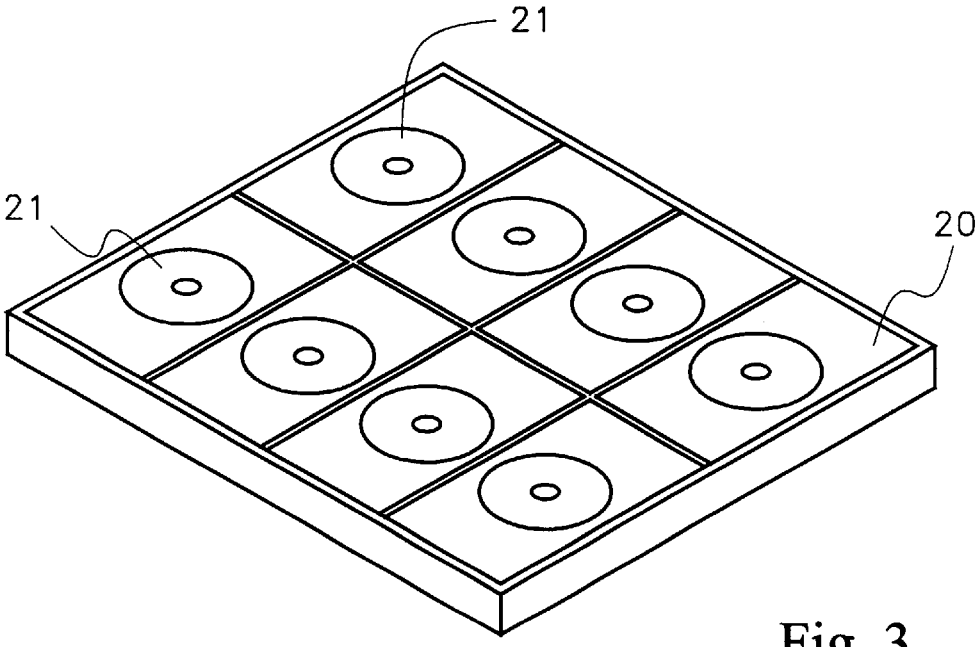
FIG. 3 is a top plan view of a rocket or projectile accommodating tray which is used according to these processes.

Referring to FIG. 3 there is shown a top view of a series of incendiary devices, such as rockets or projectiles which are all contained and oriented within a tray 20. Each of the devices 21 is predisposed or positioned in the tray 20 at a given, known location. In this manner, the tray 20 can have apertures or depressions at the bottom to accommodate the device 21 or may have indexing means such as the square cubicles as shown whereby the device 21 is contained therein in a predetermined, fixed position.

As shown, the tray 20 contains eight projectiles or rockets and is utilized in the processes to be described to carry and transport the projectiles and rockets during processing to assure that the same are in a known, predetermined position as oriented with respect to the tray, so that proper transport and movement can be implemented.

It is also ascertained that there are numerous ways of holding articles in a tray or in a carrier whereby the position of each article inserted in the tray or carrier is known, for example, as in a carton of eggs or many other devices. In this manner, the projectile or missiles are held within tray 20 in a predetermined orientation.

In order to simplify and explain the operation of the system, oftentimes in the following text, the word "projectile", "missile", and "rocket" will be used simultaneously, or the term "device" is substituted for either. It is noted that one skilled in the art understands the difference between a projectile and a rocket. It is a primary concern of the present invention to dispose of rockets, projectiles and such devices in a non-incendiary manner and to make sure that all such devices are rendered inoperative and safe after treatment by the apparatus and processes according to this invention.

In FIG. 3, as indicated, there is shown the tray 20 accommodating a plurality of devices 21. It is noted that each of the devices 21, when placed in the tray, has its fuze and bursters removed. The removal of bursters and fuzes from incendiary devices is well known. The operation has been performed for many years. Generally, a group of devices are positioned on a turntable and clamped in position. They are then rotated and an automatic machine assembly operates to unscrew the fuzes and remove both the fuses and bursters. Thus, the devices 21 shown in FIG. 3 as accommodated by the tray 20, have the fuzes and bursters removed and the devices are now positioned in the tray 20.

Referring to FIG. 4 there is shown what is designated as a Projectile Hydrolosis Vessel (PHV). As indicated and shown in FIG. 4, the tray 20 containing the devices 21 is introduced into an airlock 40. The airlock 40 is operated and controlled by a process controller 42 which process controller is a conventional process controller with programmable software which operates according to sequences to be described for the PHV and for the various other methods and apparatus.

As shown in FIG. 4, after the fuzes and bursters have been removed from the devices 21, the explosive agent is still sealed in the shell within the burster well. The tray 20 is transferred to an airlock 40 having an input access door 41. The airlock 40 is the first step associated with removal with the agent. The airlock 40 is associated with a valve 43 which is coupled to a gas reservoir 44 also under control of the process controller 42. The gas reservoir operates to cascade atmospheric flow and performs nitrogen purging to keep the agent and the propellants associated with the projectiles from affecting the atmosphere of the system and keeps the oxygen containing atmosphere from entering the airlock 40 or the PHV system.

In this manner, the PHV system is devoid of oxygen and consists mainly of a nitrogen atmosphere due to the gas reservoir 44 in conjunction with the valve 43 or controlled by process controller 42. It is understood that nitrogen can be introduced into other portions of the system as exemplified by a valve 45 also coupled to the gas reservoir 44 and under control of the process controller 42.

Figure 9:
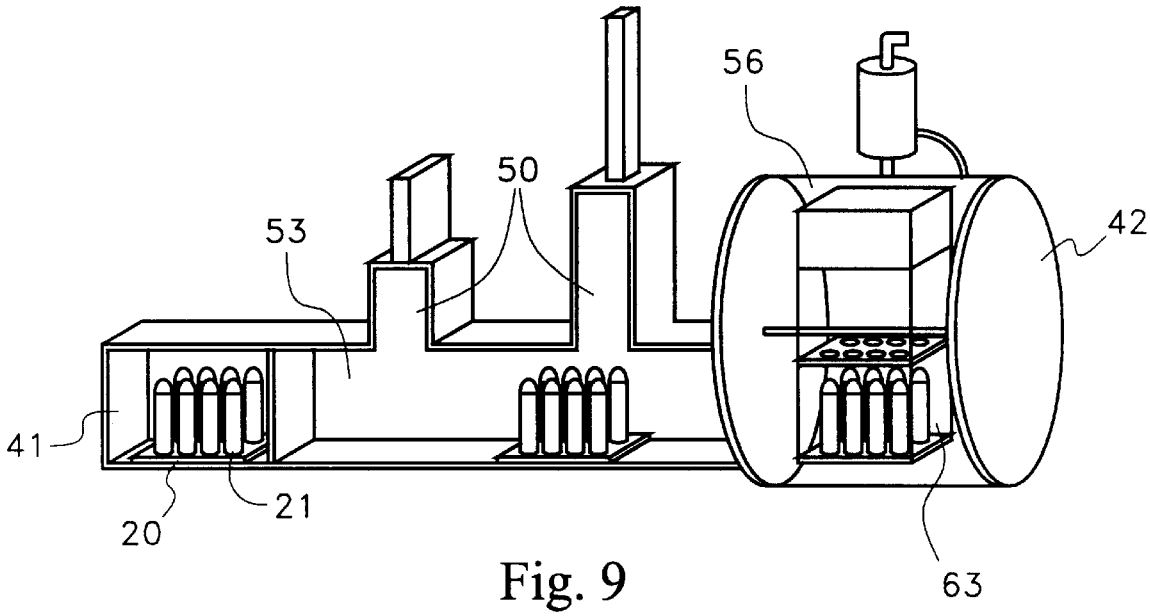
FIG. 9 depicts a graphic representation of the apparatus shown schematically in FIG. 4.

As seen in FIG. 4, the tray 20 is positioned on a conveyor belt 46 which is operated by a motor under control of the process controller 42. Thus, once the tray 20 is placed on the conveyor belt 46 and is in the airlock 40, it is under control of the process controller 42 and transported to a first process station 50. Process station 50 includes a pair of burster well punches or drills. Such devices are processor controlled and are commercially available from many suppliers. The devices 21 are indexed by the processor control so that each passes over the drills or punches of the process station 50. The drills or punches of the process station 50 are activated by the process controller 42 which indexes the tray 20 so that each of the projectiles on the tray is suitably associated with a drill or punch. The process station 50 constitutes a bay of either punch or drill devices which are associated with at least two of the projectiles (left and right). FIG. 9 shows a graphic format of the apparatus of FIG. 4 and instead of a process station 50, shows a boring station 3 where the tray 20 is moved and the projectiles are bored and then moved to a pull and place station where the projectiles are bored, are accurately positioned with the bored apertures made larger. Any relatively low friction mechanical technique for boring, punching, or drilling holes in the projectile burster well is applicable.

After entering the punch bay 53 of the PHV from the airlock 40 the tray 20 is indexed so that it positions each of the projectiles or pairs of projectiles under the drills or punches of the process station 50. The punch or drill can therefore operate on two projectiles at a time. The punches or drills descend into the burster well of the projectile and drill or punch a series of holes through the burster well of each of the devices. The drills or punches of the process station 50 are incrementally removed from the wells and are caused to punch successive hole pairs at each incremental stop before complete removal. In this manner, each of the devices 21 has a series of indexed apertures or holes punched into the burster wells. When all devices 21 have had the burster wells punched or drilled, the tray 20 is transferred through a door 55 into area 56 designated as a wash bay.

The punch or drill mechanism 51 of the process station 50 and the punch bay 53 is contaminated by the agent due to the punching or drilling process. Thus, the punch bay 53 is then washed by means of a caustic wash solution held in reservoir 60, and controlled by valve 61 under control of the process controller 42. Once the tray 20 enters the wash bay 56 the tray 20 is first engaged by a clamping and rotating mechanism which turns the tray over to permit the bulk of the agent to drain by gravity through the well apertures.

FIGS. 4A, 4B, 4C and 4D show various rotational positions of the unit in the wash bay 56. Once the tray is introduced into the wash bay 56, it is positioned in a cage 63 which is shown in the side-view in FIG. 4A. The cage 63 is associated with a series of spray nozzles 52, each of which is associated with one of the projectiles. The nozzles 52, as will be explained, are under control of the process controller 42. The entire tray 20 is rotated as shown in FIG. 4B which allows the liquid agent from the bursters to drain from the burster wells via the apertures, and to be directed towards a drain basin through a suitable drain 65.

The spray nozzles 52 are then activated by the process controller 42. There is one wash nozzle per projectile and they are then pushed or inserted into the burster wells and the wells are washed with a caustic solution (NaOH) which is directed from the spray nozzles 52. The caustic solution is the same solution which is contained in reservoir 60 and the introduction of the solution is under control of the process controller 42.

The wash bay 56 is a rotatable cylindrical member such as that of a tumbler on a washing machine and the cage 63 firmly secures the tray by means of solenoid clamps or other mechanisms to enable rotation of the entire assembly. As shown in FIG. 4C, a caustic wash is then directed via the nozzles 52 into each of the burster wells of the projectiles, wherein the entire wash bay begins to fill with a caustic solution as shown in FIG. 4C. The caustic solution 66 shown in FIG. 4C begins to fill the wash basin. The drain 65 in this position is then closed. The wash basin continues to be filled due to the continuous wash of the burster wells by means of the caustic solution directed via the nozzles 52.

As seen in FIG. 4D, eventually the wash bay 56 is filled with caustic solution and circulation continues. When the wash cycle is complete, the nozzles 52 are removed from the burster wells and the projectiles are drained through drain 65. This drain in operation can occur by vacuum or air pressure or by gravity as by rotating the wash bay 56 to the position shown in FIG. 4B. The tray 20 is then rotated to its upright position as shown in FIG. 4A and the rotating mechanism and clamping is disengaged. The tray is then moved into an airlock (not shown) for testing with nitrogen purges used to avoid contamination of the test.

As one can see, there is an output door 68 associated with the wash bay 56. The output door 68 is under control of the process controller 42 where the entire tray 20 is now moved by the conveyor belt or other device 46 to an output airlock coupled to the wash bay 56. In the output airlock, the entire tray is tested for contaminates. The test performed is designated as a Time Weighted Average (TWA) test.

The test operates to testing the contamination by using a gas chromatograph to determine the gaseous content of the air surrounding the processed tray. If the tray fails the TWA test, the entire tray of projectiles is returned to the PHV for an additional wash or may be removed from the output airlock and handled further as contaminated. If the tray passes the test, it is removed from the PHV via an exit door in the airlock.

As indicated, the above described process is controlled by the process controller 42 in the following sequence and manner. The process controller 42 performs the following programmed steps. When a tray 20 of projectiles is at the PHV airlock 40 outside the input access door 41, and the airlock is empty with the inner airlock door 401 closed the following sequences occur. The airlock 40 is purged with nitrogen by the process controller activating valve 43 which directs nitrogen from gas reservoir 44 into the airlock 40. Then, the inner airlock door 401 is opened to transfer the tray 20 by means of a conveyor or other device into the airlock 40. The access door 41 is then closed.

The next step is that the inner airlock door 401 is opened with the input access door 41 again closed. The tray 20 is now transferred to the punch or drill bay 53. When a tray of projectiles is in the PHV airlock 40, with doors closed and no tray is in the punch bay, and the wash bay inlet door is closed and the punch bay is not being washed or drained, then the following program sequence is performed by the process controller 42.

The tray is then inserted into the PHV punch bay 53. The inner airlock door 401 is closed and the airlock 40 is then purged with nitrogen. The inner airlock door 401 is opened. The tray is moved to the punch bay 53 and holes are punched in the burster wells of all devices 21 in the tray. While there are more devices in the tray to punch, the tray is then positioned to the next pair of unpunched projectiles. The holes are punched in the wells with the lowest holes punched first. While there are more holes to be punched in each of the two wells, the punch or drill mechanisms in the wells are moved to the next position. The holes are punched as a pair in each of the wells. The punch mechanisms are then returned to their fully raised positions after all holes have been punched.

The process is continued until all projectiles have the proper number of holes punched. When the wash bay 56 is empty with the input door 55 closed, then the tray 20 which comes from the punch or drill bay 53, is then moved into the wash bay 56. Input door 55 is opened to the wash bay 56 and the tray is now transferred by the conveyor to the wash bay 56. The input door 55 is then closed.

Upon closing of the input door 55, the process controller 42 activates the valve 45 to wash the punch bay 53 with the caustic wash from reservoir 60. The caustic wash is then drained from the punch bay and a new tray can be now introduced into the airlock 40. The tray which was transferred to the wash bay experiences the following operation.

When a tray of projectiles 20 is in the wash bay 56 with both the doors 55 and 68 closed, the drain and wash sequence is performed. The tray 20 is engaged by the pallet rotator and is held in place. The projectiles are firmly clamped to the tray and held. The drain agents from the projectiles are drained by gravity as the pallet is turned upside-down as shown in FIG. 4B. The drain agent from the wash bay is drained through the drain 65 as shown in FIG. 4B. This may require multiple pallet rotations and it can be done in a slow sequence or repeated a number of times.

As indicated in FIG. 4C, the wash of the projectiles in the pallet operation begins. The tray is rotated to the wash position as shown in FIG. 4C. The spray nozzles 52 are then inserted into the projectile burster wells through the holes and all projectiles are washed. The washed projectiles drain as the wash bay is being filled, as shown in FIG. 4D. The tray is then rotated to its upright position as shown in FIG. 4A and the pallet rotator and holder is disengaged from the tray.

When no tray is sitting outside the output door 68, then the tray is removed from the wash bay. The output door 68 is opened and the transfer of the tray is accommodated through the output door 68 to an output airlock (not shown) where it is tested via a TWA test. The output door 68 is then closed, and the sequence is repeated for another tray which is directed into the wash bay 56.

According to the above-noted method, one can understand that a high production rate is achieved by processing a batch of projectiles at a single time. The use of a closed bay such as the punch bay 53, the wash bay 56, and airlock 40 reduces the risk of contamination. The extending spray nozzles 52 which extend when the feed line is pressurized enable thorough removal of all agents from the projectile bodies of the burster wells. The decontamination spray system in the punch bay and the use of a full emersion bath in the wash bay enables a clean environment inside the two bays.

The technique described above further eliminates the need for burster well handling. The burster well always remains as part of the projectile body. Thus, as one can see, the above-noted process operates to completely decontaminate the projectiles by removing all agent from the burster wells, and by treating the burster wells and projectiles with a caustic wash. The agent is removed by gravity, and then the burster wells continuously washed by a caustic solution by means of the wash bay operation whereby the effect is to completely eliminate the agent by using a gravity drain of the agent and then neutralizing whatever agent remains in the wash bay to a safe level.

As previously indicated in the above-noted discussion, a rocket as compared to a projectile contains a fuse and a burster section. Basically, the burster in a rocket is a munition imbedded in the rocket war head and the burster operates to detonate the war head when the missile or the rocket nears or strikes its target. It is a well known technique to remove fuzes and bursters from rockets as indicated above by means of a turntable and suitable mechanisms. The bursters which are thus removed must also be disposed of.

Figure 5:
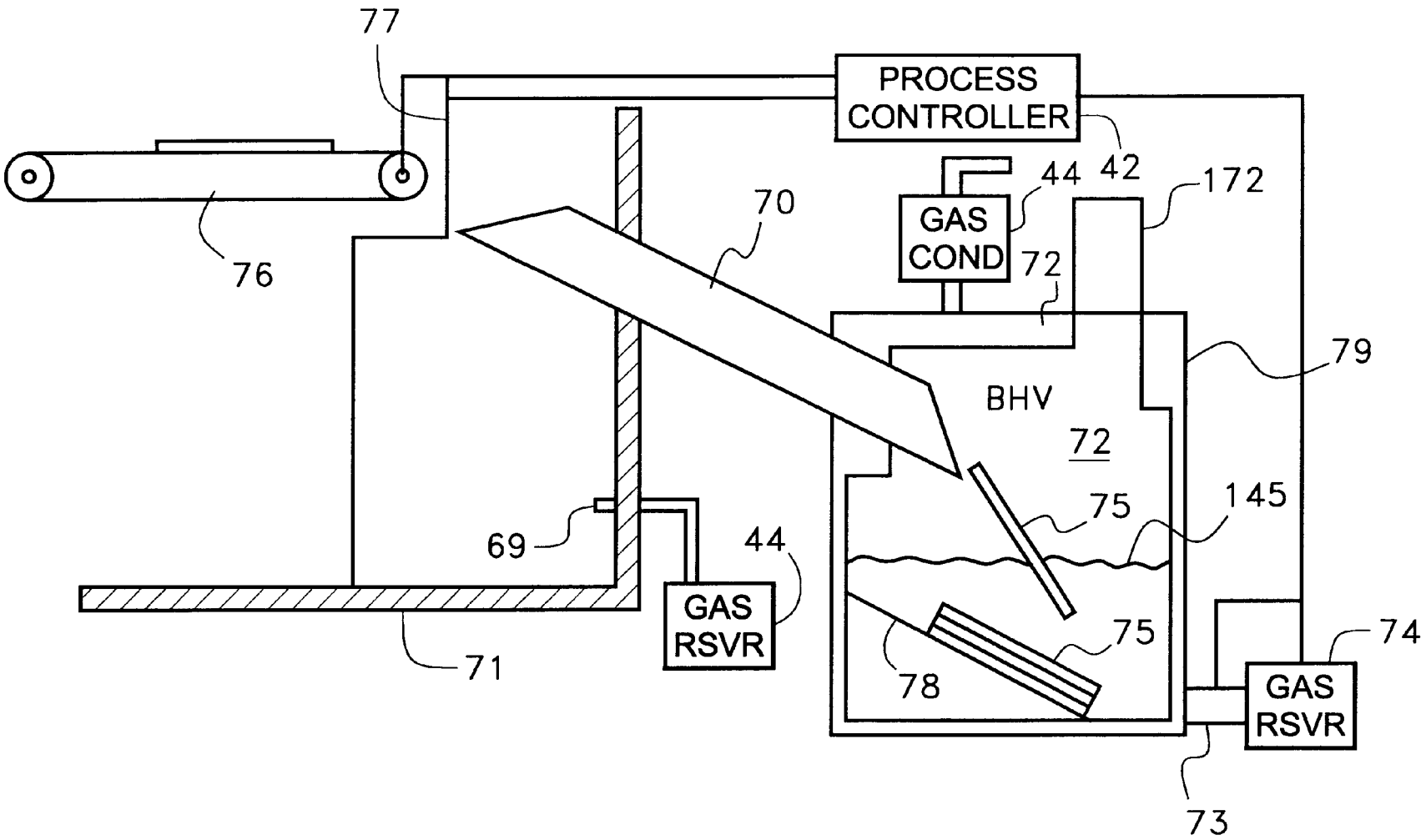
FIG. 5 is a schematic showing a technique for hydrolyzing bursters associated with projectiles.
Figure 10:
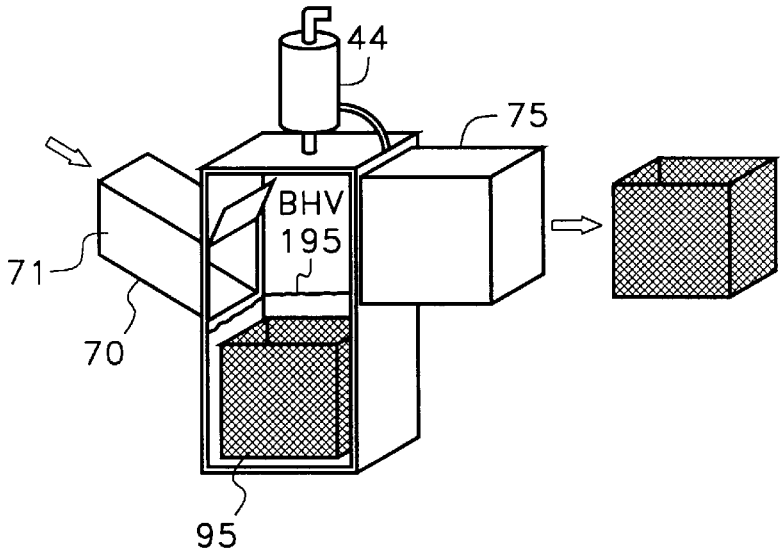
FIG. 10 represents a graphic depiction of the apparatus shown graphically in FIG. 5.

Referring to FIG. 5 there is shown a burster disposal technique which is used in conjunction with this invention. FIG. 10 is a graphic showing the typical structural components as is schematically shown in FIG. 5. As seen in FIG. 5, the bursters 75 are transferred one at a time through an airlock 71 to a burster hydrolysis vessel 72 (BHV) for neutralization. The BHV contains a basket 95 for holding the burster. When a burster 75, which is positioned on conveyor belt 76, is in the airlock 71, the BHV control system via processor 42 will open the airlock door 77 and the burster is gravity fed in to the BHV 72 to fall in the basket 95 containing previously accepted bursters which are hydrolyzing in a heated caustic solution. The heated caustic solution is provided by a caustic reservoir 74 which is coupled to an inlet port 73 having a valve under control of the process controller 42.

Thus, as seen the bursters 75 are piled or stored on an inclined surface 78 to enable the caustic solution to flow past the bursters. The inclined surface 78 of the basket 95 has a tilt angle to facilitate flow of the energetic material as it melts out of the phenolic burster tubes. The direction of flow for the caustic solution is uphill so to encourage rapid melting and dissolving of the energetic material associated with the burster. The basket 95 is filled as more bursters become available, and when full or when it is desired to expedite those bursters already accumulated, no further bursters are accepted and the airlock door 77 is not opened by the process controller.

In this manner, the hydrolization process is allowed to continue for a sufficient time to complete the processing of the last burster added. The caustic solution employed is a sodium hydroxide solution preferably of about 20% sodium hydroxide.

Once all the bursters have been hydrolyzed and the basket 95 is removed with the phenolic tubes associated with the bursters via airlock door 77. The basket 95 is raised above the wash fluid and allowed to drain. Then it is passed into an airlock for the TWA test as indicated in conjunction with FIG. 4. The airlock is a conventional airlock associated with the TWA test.

If the test is satisfactory, the basket 95 will be removed and an empty basket will be inserted into the BHV vessel. Those baskets not passing the test will be returned to the wash for additional processing or removed and handled as contaminated. The process shown in FIG. 5 including the operation of the process controller 42 will be described in greater detail.

Projectile bursters 75 are removed from the projectiles by conventional techniques and provided to the BHV 72 via an airlock 71 with the doors closed. To accept the burster, the burster has to be in the airlock 71 with airlock door 77 and output door 79 closed and the number of bursters in the basket associated with BHV 72 has to be less than the maximum allowable and there has to be no reason for removing the cooking bursters from the BHV 72. If the number of bursters equals the maximum allowable in the basket 95 and the cook time for the last burster added to the BHV 72 is greater than the required cook interval, or if there is some other reason to remove the burster basket and cook time for the last burster added to the BHV 72 is greater than the required cook interval, then the burster basket is removed from the BHV 72.

There are other reasons to remove a burster basket of fully cooked bursters which can include (1) a need to perform a maintenance check; (2) the end of a shift approaching; (3) no bursters are available in the airlock 71; and (4) for any other reasons.

When the bursters are introduced into the basket 95 associated with the BHV 72, they are cooked with the heated caustic solution from the reservoir 74 being directed into the BHV 72 by the process controller 42 with the caustic flowing uphill on inclined surface 78 until another burster is accepted or the burster basket is removed. If another burster is accepted, then it is directed into the inclined tube 70 through the conveyor belt 76 or by other means, whereby the door 77 is opened by the process controller 42. If this is done, then the airlock 71 is again purged with nitrogen by means of a conventional valve 69 which is connected to gas reservoir 44 as also shown in FIG. 5.

The entire airlock 71 is purged with nitrogen, the airlock BHV door 77 is opened and the burster 75 is then fed by gravity via the inclined tube 70 into the BHV 72. It can be seen each burster 75 is oriented with a downward slant in line with the direction of caustic flow. A timing clock is started by the process controller 42 to monitor the required cook time.

This cook time is monitored by a typical counter located in the process controller 42. The airlock door 77 is then closed. If the burster basket is full and the required cook time has been completed, then the burster basket is removed from the BHV 72, the output door 79 is opened, the basket of cooked bursters including the phenolic shells is removed from the BHV. The empty basket is then inserted back into the BHV and set into place with a new operation to occur. In this manner, the door 79 is closed and the steps are again repeated.

As seen in FIG. 5, bursters are handled without any need for blast containment, as this process described is totally a non-incendiary process. There is no need for special handling mechanisms as the bursters are gravity fed into the collection basket associated with the BHV 72. The burster tubes are inclined on inclined surface 78 in the caustic bath such that the burster material drains out of the tube. The flow is such that the melted burster material will not pool at the bottom of the vessel.

As one can ascertain, the process is completely non-incendiary, the burster material is melted then hydrolyzed to enable complete neutralization. Only the safe phenolic burster shells are left and they are totally decontaminated by the action of the hot, caustic sodium hydroxide solution which is fed from the caustic reservoir 74 through the inlet port 73, all under control of the process controller 42.

Figure 6:
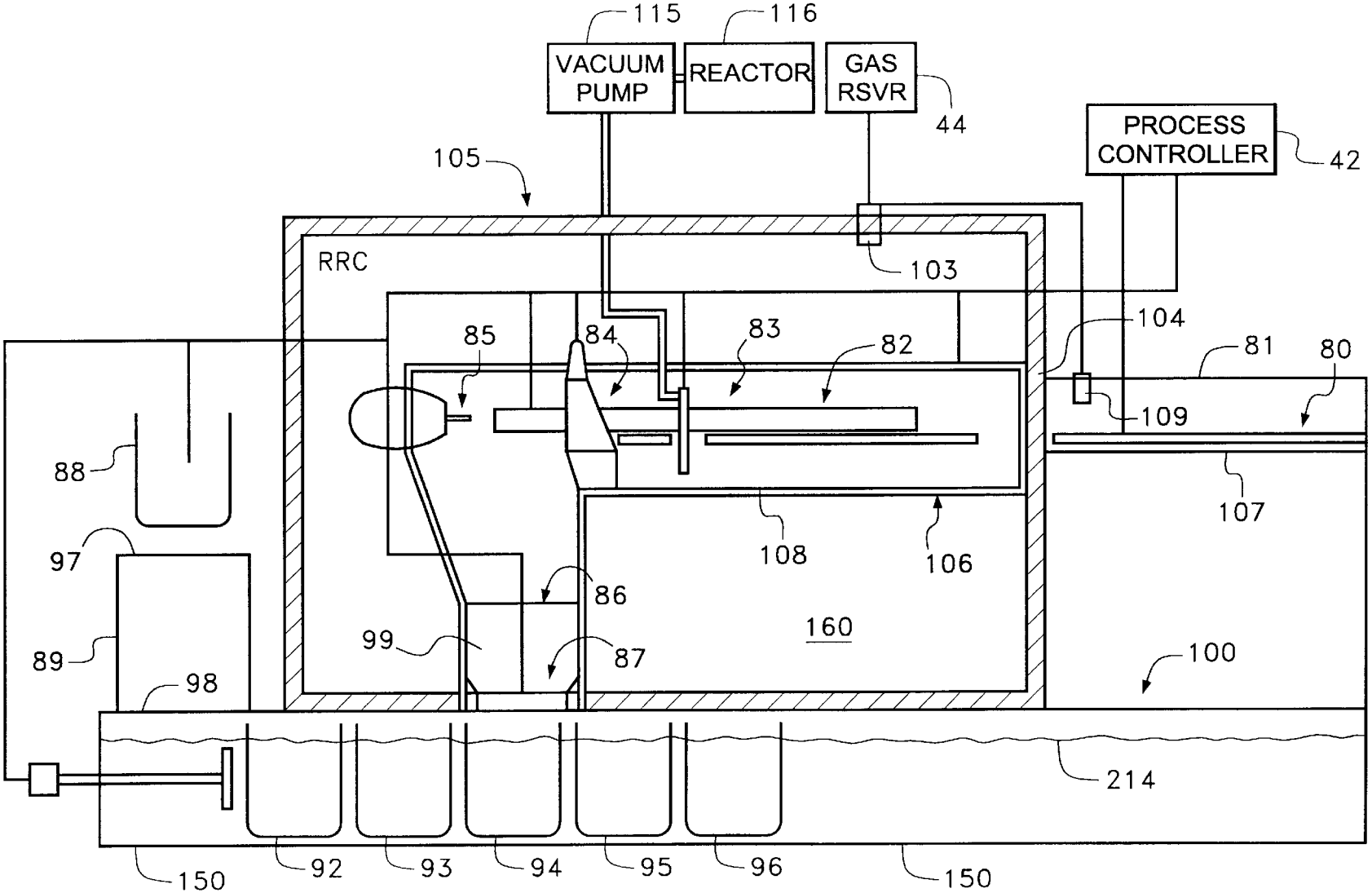
FIG. 6 is a schematic showing a rocket reverse assembly chamber for processing rockets in order to shear such rockets and in order to decontaminate the rockets and the associated agents.
Figure 8:
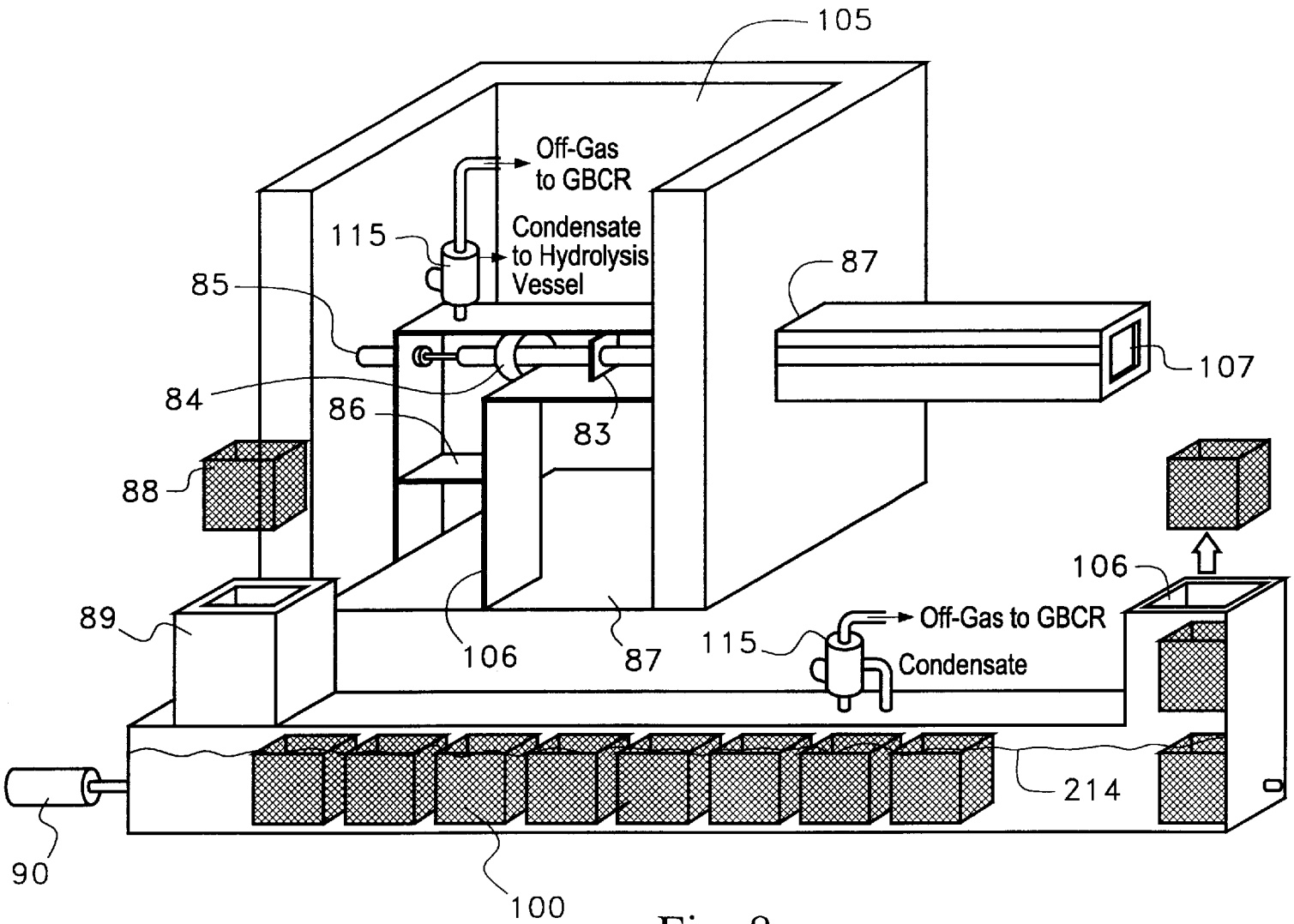
FIG. 8 depicts a graphic representation of the apparatus shown schematically in FIG. 6.

Referring to FIG. 6, there is shown a schematic of an apparatus which implements a method for disposal of a rocket assembly. FIG. 8 shows a graphical display of the apparatus in a formal view with parts indicated by numerals 1–14 which show the components in FIG. 6. As one can ascertain, rockets or missiles can be much longer and more expensive than projectiles and are of a different structure as shown in FIG. 1 and FIG. 2, although they have common parts. Referring to FIG. 6, numeral 81 refers to an airlock which has a conveyor belt 80 associated therewith. The airlock 81 has an outer door 107 which can be opened or closed selectively by means of the process controller 42.

The rocket 82 assembly may be placed on conveyor belt 80 where it is transported to input door 104 of a chamber 105 designated as Rocket Reverse Assembly Chamber (RRC). The chamber 105 (RRC) has a strong outer wall made from a structural steel and may be a lead lined chamber which is extremely thick to protect against inadvertent explosions. The rocket 82, as transferred by the conveyor belt 80, is directed through the input door 104 which opens, as will be explained, under control of the process controller. The rocket 82 is positioned on a second conveyor within the RRC, where it first is introduced to a punch and drain assembly 83. This assembly 83 is also under control of the process controller. The punch and drain assembly 83 comprises a series of punches, drills, or boring devices where a baseline punch and drain subsystem operates to punch or create apertures in the rocket body to drain the majority of the agent from the rocket body 82. Punch and drain clamps associated with the station, which are solenoid controlled, descend from above and raise from below to engage and hold the rocket section firmly in place.

The holes are punched in the bottom of the rocket assembly for draining and holes are punched in the top of the rocket assembly for venting and the agent is sucked from the rocket via a vacuum pump and sent to a reactor which is shown and represented by numerals 115 and 116. These operations are under control of the process controller 42 which controls the vacuum pump 115 and operates to suck the agent from the punch and drain location. Holes are punched as indicated to enable such draining. The agent is also drained from the holes by gravity and falls upon the drainline 106 so that agent drains into the agent reservoir 160. The rocket 82 is advanced by means of the conveyor under control of the process controller to a shear assembly 84. The shear assembly 84 is a typical shearing device which may comprise two or more blades which operate to shear the rocket at predetermined increments as controlled by the process controller.

The first step in the shear operation is to cut off the fuze section of the rocket. The next step is to shear the upper rocket sections. The size for the cuts is controlled by the process controller and are a function of the particular rocket being accommodated. Correct sizes are determined for each of the rockets, and the shear assembly 84 operates as a controlled cutting device. When a shear cut exposes the propellant section of the rocket which is the midsection of the rocket, an extendable caustic nozzle with a rotating head indicated by numeral 85 is used to remove the majority of the propellant. The nozzle 85 is as indicated, an extendable rotating head spray nozzle which is operated under control of the process controller 42.

The nozzle is extended into the body of the rocket and begins to rotate and spray caustic solution to remove the propellant. After a given interval, the rocket is again sheared and the propellant section is reduced while continued to be sprayed and rotated by the nozzle 85 using a caustic material such as sodium hydroxide. The rocket pieces as indicated, fall to the top of the collection bin door 86 which operation (open and close) is also under control of the process controller. The collection bin door 86 opens, allowing the pieces thus treated, to enter the blast door 87.

As one can see, a series or queue of baskets as 92, 93, 94, 95, and 96 are positioned in a channel 150 below the blast door 87. The progression or movement of the baskets is controlled by an actuator 90 under control of the process controller. As seen, an empty basket 88 is positioned above an upper airlock door 97 of a basket insertion airlock 89. The basket 88, once entered into the basket insertion airlock 89, is then dropped through a lower airlock door 98 as the actuator arm is retracted to form part of the actuator basket or queue assembly as 92, 93, and 94. As seen from FIG. 6, the process controller opens the blast door 87, thus depositing rocket parts into the basket 94. The basket 94 is then moved along with the other baskets so that basket 93 is ready to receive the next series of rocket parts.

The basket 94 is filled with the parts and the used caustic wash is discharged by means of the rotating head spray nozzle 85. Thus, the basket with the rocket pieces is pushed along by actuator 90 through the output baffle and then into a collection site.

As one can ascertain, a large rocket is taken and sheared into many small pieces. Each of the pieces contain a relatively small volume and are directed at intervals through the blast door into an associated basket. The materials deposited in the basket have been totally cleaned and decontaminated by means of the rotating head spray nozzle which sprays a caustic slurry or bath to these parts. The bath or slurry is further contained within the output channel 150 where the parts continue to be decontaminated. The entire basket containing the parts is then moved through the channel to the output where they are collected and tested again for gaseous content.

The operation of the process controller 42 in conjunction with the apparatus of FIG. 6 will now be more clearly explained. Referring again to FIG. 6, when a rocket is at the RRC outer door 107 and the airlock 81 is empty with both doors 107 and 104 closed, then door 107 is opened and the rocket is inserted into the airlock with the rocket and firing tube placed onto the conveyor belt 80 which is now stationary. The outer door 107 is closed.

The airlock is then purged with nitrogen as the process controller activates valve 109 which is coupled to the gas or condenser (nitrogen) reservoir 44. The input door 104 is opened and the rocket is now transferred into the RRC chamber 105 where it is directed to the conveyor in the chamber. The input door 104 is then closed, and the system is now ready for the next sequence as the airlock 81 is empty.

The rocket 82 is now in the RRC chamber 105. The rocket 82 as indicated is loaded from the airlock 81 into the RRC. The input door 104 is then closed. The rocket then is secured by punch clamps which are under control of the process controller 42 where the rocket is held from top and bottom and securely held in place. The punch and drain assembly 83 is activated to punch holes or drill the top and bottom surfaces of the rocket, mainly in the propellant section. The fuze section of the rocket has already moved past the shearing mechanism 84. The punched holes enable the propellant to drain into the agent reservoir 160 via drain holes 108. This is also accommodated by means of the vacuum pump 115 which sucks the agent into the reactor 116. After a given time interval, as a function of the particular rocket, the punch clamps are retracted.

The rocket is sheared by means of the shearing mechanism 84. The fuze as indicated is the first section sheared. The rocket is then moved by means of the conveyor to continue to shear the most forward remaining sections. These sheared sections drop into the hopper where they fall on collection bin door 86. Once the propellant chamber is exposed, the rotating head spray nozzle assembly 85 is activated.

This causes caustic material to be sprayed into the propellant chamber. The rocket at the same time is being sheared at predetermined intervals while the caustic material is being sprayed. The rocket is still clamped. As long as multiple rocket sections remain, they continue to be sheared and the rocket is moved into position for the next shear. The shearing action continues, where each section drops on top of the collection bin door 86 which is controlled by the controller 42. When the blast lock area 99 is empty and the blast door 87 is closed, the collection bin door 86 is opened and the rocket pieces are deposited into the blast lock area 99 and now sit on the top of the blast door 87.

The process controller now closes collection bin door 86 and opens the blast door 87 and the rocket pieces and the used caustic fall, where they are caught by a basket such as 94, 95 and 96. Then the blast door 87 is closed and the process is repeated. As one can see, the equipment used is existing punch and drain assembly 83 which is well known in the field and has been widely employed. The shearing mechanism 84 is also a well known mechanism and is available from many companies. Each of the individual baskets as 92, 93 and 94 provide a contamination boundary which minimizes the risk of contamination as all rockets parts are never contained in one vessel.

As one can ascertain, there is again described a non-incendiary method of disposing of rockets. The rockets can be very large as each one is sheared into small volumes and the pieces are dropped into separate containers where they are further decontaminated. As one can see the propellant is removed in a slurry for rapid neutralization in the reactor 116. There is a controlled transfer of all parts to the next process as the actuator 90 shown in FIG. 6 under control of the process controller 42 can move the baskets at any predetermined rate. In this manner, the process is a self-decontamination process which uses propulsive material in a slurry for rapid processing while providing safe containment until the next unit is ready to receive the part and the slurry. Again, each of the baskets can be subjected to a separate time weighted average test (TWA) using a chromatograph and to determine whether all contaminants have been safely removed. This test is performed in an airlock.

Figure 7:
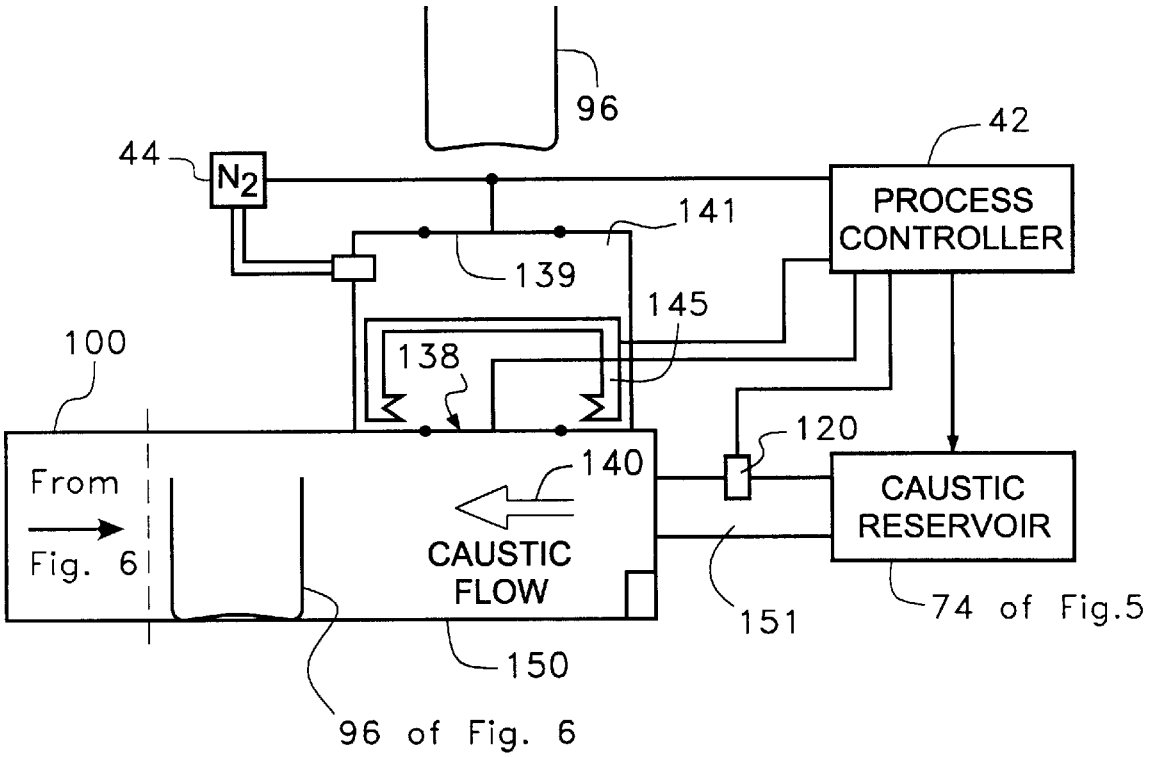
FIG. 7 is a schematic depicting an additional apparatus and steps utilized in decontamination and disposal of rocket parts after being treated with caustic slurries.

As one can see from FIG. 6, the output baffle 100 has an arrow directed to FIG. 7. Referring to FIG. 7, there is shown the basket 96 of FIG. 6 approaching the output of the system. As one can understand the entire basket accommodating channel 150 is connected to a port 151 to the caustic reservoir 74 as of FIG. 5. This caustic reservoir, contains a solution of sodium hydroxide (NaOH) which is directed into the channel 150 through the port 151 under control of a valve 120 which is under control of the process controller 42. Essentially as described in the above, the rocket hydrolyzing vessel REV 200 processes the rocket pieces and deposits them in the queue of baskets as 92, 93, 94, 95 and 96 through the blast door 87. Each basket holds certain pieces from one rocket. Since the time for hydrolyzing is considerably longer than that for reverse assembly, the REV 200 contains the queue of baskets with increasing accumulated hydrolyzing time as the baskets progress from the input or actuator side towards the output or caustic flow side. The fresh caustic solution from reservoir 74 flows from the oldest baskets towards the freshest baskets as indicated by the direction of arrow 140 designated as caustic flow. When a basket such as 96 reaches the removal station location determined by door 138 and associated with airlock 141, it is eventually transferred into the airlock 141 and there tested for contamination. Again, the test is the TWA test.

The queue of baskets which may comprise 10 or more baskets, contain different and separate pieces of the missile or rocket. If an individual basket fails the TWA test, it is returned to the REV for additional processing or removed and handled as further contaminated. If a basket such as 96 passes the TWA test, it is removed from the airlock via the door 139. The remaining baskets are indexed and the empty basket as 96 is inserted through the basket insertion airlock 89 and is positioned at the entry station.

When this occurs, the system may receive pieces of a new rocket, which have been placed in the blast lock of the apparatus through the blast door 87 with the rocket pieces again guided to ensure proper entry into the baskets as the blast door 87 is controlled by the process controller.

The operation and control of the blast door 87 is as follows. When the rocket parts are in the hopper and are sitting on collection bin door 86 and collection bin door 86 is closed and an empty basket such as 94 is in place below the blast door 87, and lower airlock door 98 is closed then the following operation occurs. The process controller opens collection bin door 86 allowing the rocket pieces to fall on top of blast door 87. Blast door 87 is then opened, the rocket pieces fall into the basket 94. The door 87 is closed and door 86 is closed. In order to insert a basket, the following conditions have to occur.

When there is no basket in the basket insertion airlock 89 and an empty basket 88 is located outside the upper airlock door 97, and the lower airlock door 98 is closed, then the airlock door 97 is opened and the basket 88 is inserted into the basket insertion airlock 89 via the open upper airlock door 97. The basket is then transferred into the airlock 89. The upper airlock door 97 is closed and the actuator is retracted, the lower airlock door 98 is opened and the basket is allowed to enter the channel 150.

In a similar manner, referring to FIG. 7, if the output airlock 141 contains a basket and the basket passes the TWA test, and no basket is sitting outside the output door 139 then the basket can be removed from the output airlock 141 by opening the output door 139. The basket is removed with an automatic removal apparatus or can be removed manually by means of a person wearing proper decontamination equipment. The basket 96 is removed from the output airlock 141 and the removal mechanism can be disengaged with the basket 96 returned to the starting position as indicated by basket 88 of FIG. 6. The output door 139 is closed and the sequence is repeated.

In regard to the sequence for decontamination, it is noted that the following operations occur. The rocket pieces are cooked in the caustic bath for one-cycle interval, where a normal cycle interval equals the number of cook stations (baskets) which correspond to a required cook interval. As indicated, the slurry which is a solution of sodium hydroxide operates on the various rocket parts to decontaminate the same. The rocket parts insertion station and the removal station are not cook stations. The cook station includes the caustic bath which is accommodated when the rocket parts are in the caustic solution flowing in the channel 150. The proper cook time, or the time that rocket parts are allowed to remain in the slurry, is a function of the representative TWA tests.

As one can ascertain, depending on the rocket size, one determines how long the rocket parts for different types of rockets, and for the sheared piece sizes should remain in the caustic solution. The caustic solution flows from the removal station to the insertion station as seen by arrow 140 shown in FIG. 7. The caustic solution is pushed from the caustic reservoir to flow down towards the actuator 90. When the output airlock is empty with the outer door closed, then the oldest basket load of rocket pieces which pass under lower output door 138 of FIG. 7 can be placed in the airlock and removed. That basket is moved or pushed into output airlock 141. Prior to this, the airlock 141 is purged with nitrogen to avoid possible contamination of the TWA test. The lower output door 138 (FIG. 7) is opened, the basket 96 is engaged by a lift mechanism 145 or otherwise pulled into output airlock 141. The lift mechanism 145 is disengaged from the basket and returned to the start position and the lower output door 138 is closed. The test for TWA is made. If the basket in output airlock 141 does not pass the test, it must be cooked longer and the lower output door 138 is opened, the basket is dropped into the channel 150, the lift mechanism is disengaged from the basket, the lower output door 138 is closed, and the basket now remains in the channel. The baskets continue to be advanced. When a basket 96 is again at output door 139 and the output door 139 is closed, and there is no new basket at the input station, then the following occurs.

The upper airlock door 97 is opened, the basket 96 is transferred to the input station from the output airlock 141, and the lower airlock door 98 is closed. In this manner, the basket queue keeps going. As one can see from the above, the vessel RRC provides a contamination boundary, reducing the risk of plant contamination. Because the unit is outside the explosion containment room, there are no constraints with regard to the number of sheared rocket parts which are implemented in the RRC. The RRC is contained within the explosion containment chamber 105 as indicated.

It is noted that while mechanisms have been shown in general terms and in the form of block diagrams. that all components including the conveyor assemblies, the shearing assemblies, the hoppers and so on, are in fact available from many sources. The process control has been described in detail. The inherent fact is a system is described for non-incendiary disposal of rockets and projectiles and parts thereof which is self-contained, and which uses chemical neutralization of the energetics and agents in a near continuous process and due to the shearing steps, yields safe to handle material. The continuous character of the process enables it to be fully automatic to enable transfer from hazard to safe in a single self-contained unit, using a minimum amount of energy and using rapid processing techniques.

Referring to FIG. 8, there is shown a complete graphic depiction of the rocket neutralization machine (RRC) which is shown in schematic form in FIG. 6. In FIG. 8, the legends utilized on the diagrams consist of numerals 1–14. To the left of the legend, indicative of the apparatus shown in FIG. 8, is the equivalent numbers as depicted in FIG. 6. Various items such as the control processor 42 have not been depicted in FIG. 8 but the nature of each of the items in regard to actual mechanical structure is more clearly shown in FIG. 8 and should be viewed in conjunction with FIG. 6 with the above-noted description.

FIG. 9 depicts a graphic representation of the actual machine structure as implemented by the schematic types of diagram depicted in FIG. 4. The legend in FIG. 9 which uses the numerals 1–8. At the left side (FIG. 9), the numerals of FIG. 4 are depicted showing the equivalent structure, as done for FIGS. 6 and 8 above.

It is noted that in FIG. 9, instead of a drill or punch area 50 there is a two-step operation where numeral 3 represents a boring station where the burster wells are first bored, while numeral 4 represents a pull and place station where the burster wells which have been bored with apertures are then pulled into position so that they will align with the nozzles 52 associated with the rotating projectile wash cage. It is, of course, understood that there are many other techniques which are available for boring holes in the burster wells.

FIG. 10 shows a graphic depiction of the apparatus which is presented in schematic form in FIG. 5, and again the legends employed in FIG. 10 are reference numerals 1–4 and the corresponding numerals in FIG. 5 are given at the left.

Figure 11:
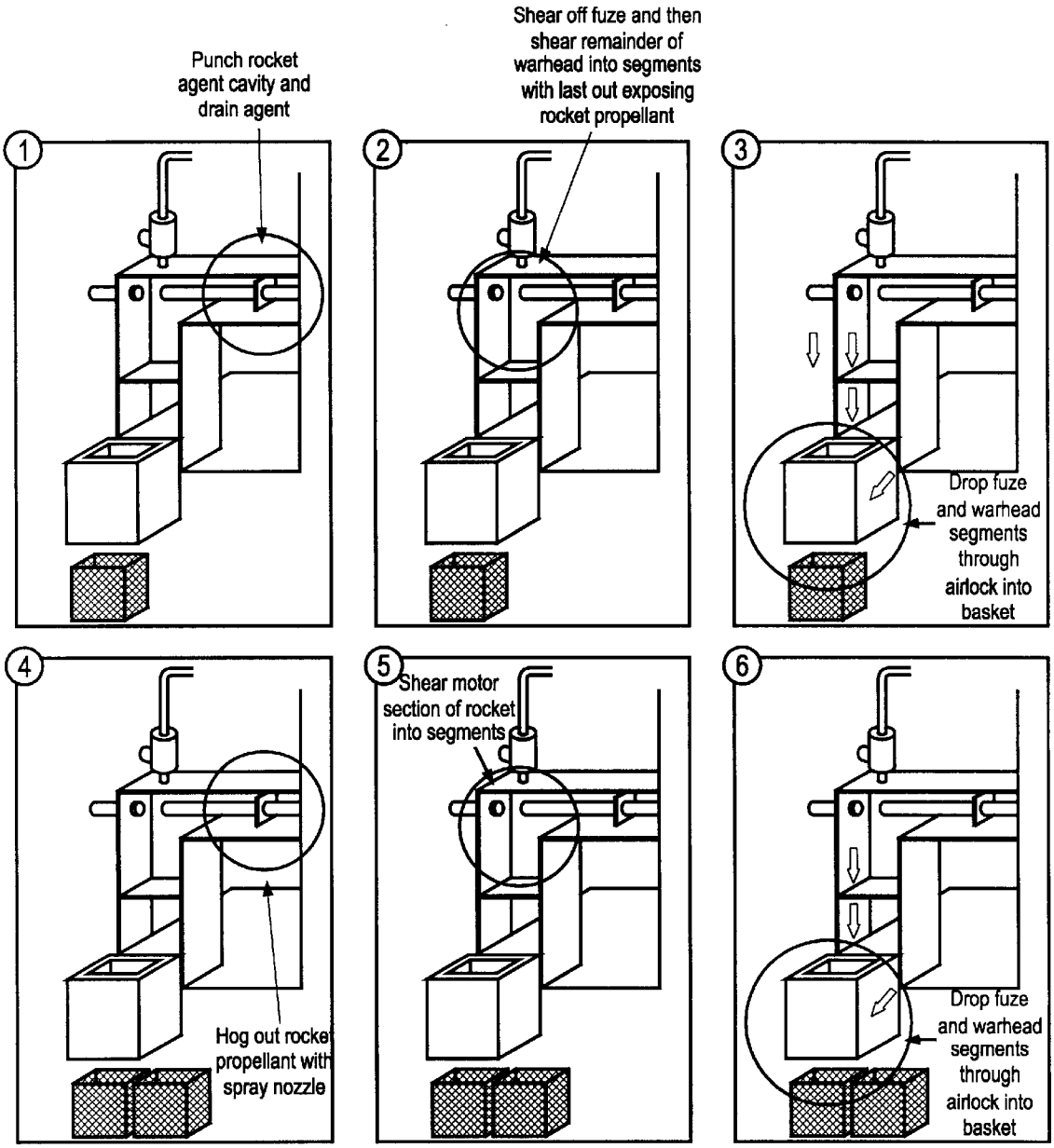
FIG. 11 consists of six separate FIGS. 11-1 to 11-6 showing specific graphic steps relating to the method and apparatus depicted in FIGS. 6 and 8.

FIG. 11 shows six separate graphic indications which each represents a portion of the process which is implemented by the apparatus shown in FIG. 6 and FIG. 7. As one can see, if one looks at the first insert designated by reference numeral 1, one sees that the apparatus begins to punch the rocket agent cavity and drain the agent which is done at station 83 of FIG. 6. The next legend, which is 11-2, shows the shearing off of the fuze, and then shearing the remainder of the war head into segments, exposing the rocket propellant. This is shown in FIG. 6 and is implemented by means of the nozzle and description associated with module 85 of FIG. 6.

The insert 11-3 shows that the fuze and war head segments are dropped through the blast door 87 and into the basket 94 as shown in FIG. 6. In 11-4 it is shown that the propellant is forced out with the spray nozzle 85 as soon as the propellant cavity of the rocket is exposed. FIG. 11-5 shows the shearing of the rocket motor and sections into smaller pieces which are then disposed in baskets through the airlock. FIG. 11-6 shows that the rocket motor segments and various other materials are dropped into the basket through the airlock. Thus, FIG. 11 is a representation of six graphics, which show in clearer detail, the various steps already described in conjunction with FIG. 6 and implemented by the graphic apparatus shown for example in FIG. 7.

Figure 12:
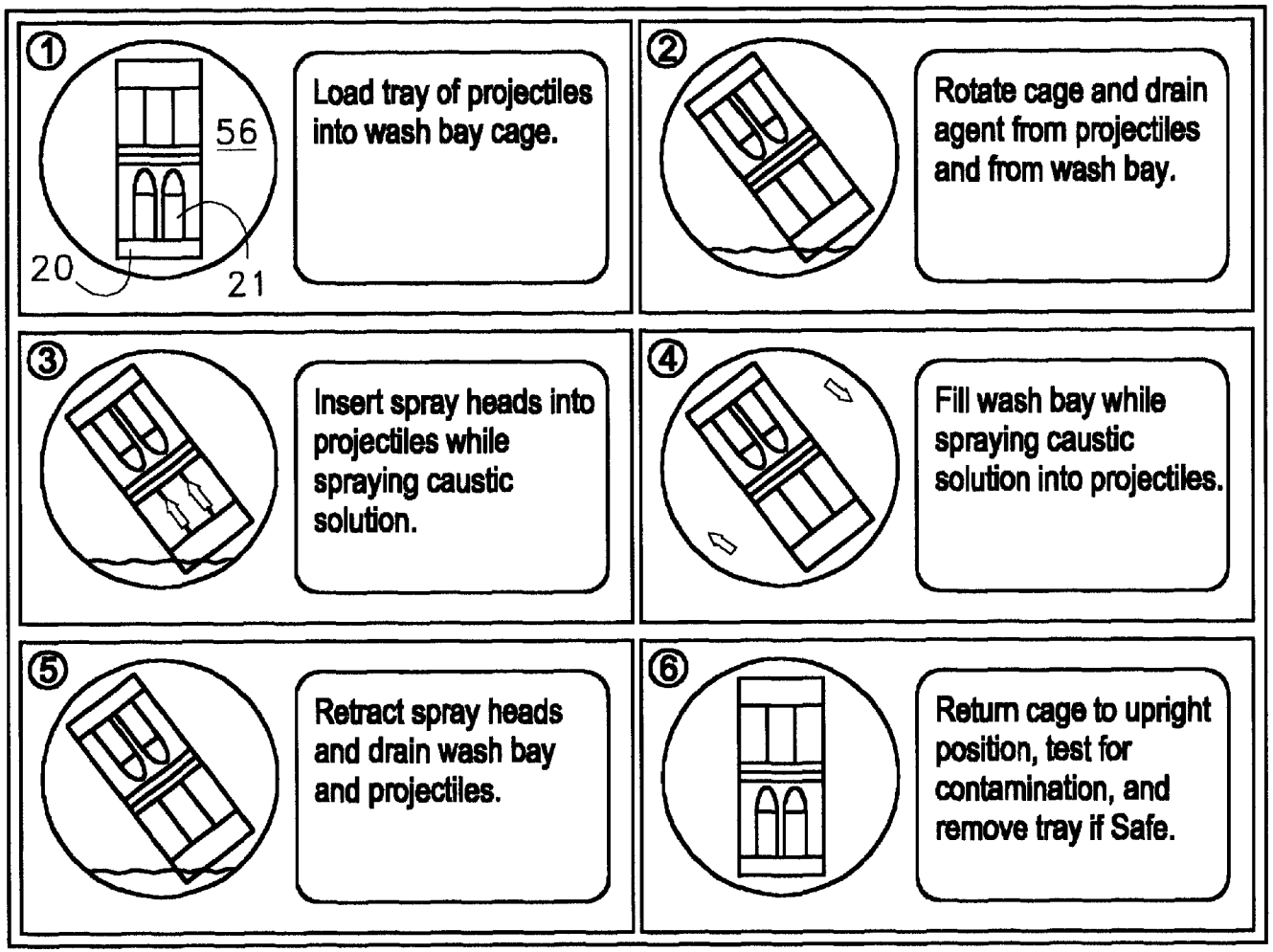
FIG. 12 shows six graphic inserts, namely 12-1 to 12-6 depicting method and apparatus operation shown in particular to FIGS. 4 and 9.

FIG. 12 shows six inserts which are graphic displays showing the process depicted in FIGS. 4 and 9. For example, referring to insert 12-1, it is seen that the tray 20 as shown in FIG. 4, is loaded with devices 21, and is now in the wash cage 63 of FIG. 4. In step 12-2, the cage is rotated and the drain agent from the projectiles is drained from the wash bay. This is also described in conjunction with FIG. 4, and is shown for example in FIG. 4B.

In 12-3, it is seen that the spray heads are inserted into the apertures formed in the burster well of the projectiles while spraying the caustic solution as is shown in FIG. 4C. In FIG. 12-4, there is shown that the wash bay is filled with the caustic solution while the spraying of the projectiles continues as shown in FIG. 4D. 12-5 shows retraction of the spray heads and the draining of the wash basin which has been described in conjunction with FIG. 4, while FIG. 12-6 shows the cage returned to its original position for the TWA contamination test, which is shown in FIG. 4A for example.

Thus, FIG. 12 gives a graphic description in regard to certain steps of the process described in FIGS. 4 and 9.

It is thus believed that with the above-noted graphic displays, in conjunction with the schematic diagrams that one skilled in the art would have no difficulty in understanding the process and apparatus employed.

What is claimed is:

1. A method of neutralizing and rendering a burster, having an incendiary energetic material for a projectile or similar device, harmless without exploding said burster, comprising the steps of:

placing a burster on an inclined surface at a given tilt angle in a container;

introducing a caustic solution into said container;

causing said caustic solution to flow up said inclined surface; and bathing said burster in said caustic solution until said energetic material melts and drains from said burster and wherein said inclined plane and said given tilt angle further encourages said melting of said energetic material.

2. The method according to claim 1 wherein said burster is gravity fed into said container and falls by gravity on the surface of said inclined plane located at the bottom of said container.

3. The method according to claim 2 wherein said caustic solution is a heated slurry of sodium hydroxide.

4. A non-incendiary method of disposing of a plurality of devices which each include a burster and fuze that contains an energetic incendiary explosive material, and a burster well that contains a chemical agent, said method disposing of said devices in a manner that renders said devices harmless, said method comprising the steps of:

removing the burster and fuze from each of said devices;

hydrolyzing each of said bursters and fuzes with a caustic solution heated above room temperature to remove and deactivate all the energetic material contained therein;

placing said devices in a container maintained in an atmosphere substantially devoid of oxygen;

forming a series of holes through said burster well of each of said devices;

draining the chemical agent from the burster well of each of said devices via the holes formed in the burster well;

hydrolyzing each of said devices with a caustic solution heated above room temperature to neutralize and remove all remaining chemical agent remaining in the burster well.

5. The method according to claim 4, wherein the step of hydrolyzing each of said devices includes spraying said caustic solution by nozzles.

6. The method according to claim 4, wherein the step of hydrolyzing each of said devices includes immersing said devices in a caustic bath.

7. The method according to claim 4, further including the step of:

shearing said devices into smaller pieces prior to the step of hydrolyzing each of said devices.

8. The method according to claim 7, further including the step of distributing said pieces in a plurality of containers wherein each container holds some of said pieces and then hydrolyzing each container in a controlled sequence wherein said container passes through said caustic solution for a different period dependent upon the location of the container in relation to the sequence.

9. A method of decontaminating a plurality of devices, each of said devices including a fuze at an end thereof, a chemical agent in a first chamber thereof, and an explosive propellant in a second chamber thereof, said method comprising the steps of:

(a) positioning one of said devices in an airlock having an atmosphere consisting substantially of nitrogen;

(b) advancing said one device to an aperture forming station;

(c) forming apertures in said first chamber of said one device;

(d) draining said chemical agent from said first chamber of said one device through said apertures;

(e) advancing said one device to a cutting station;

(f) cutting away pieces of said one device starting with said fuze at said end thereof until said second chamber of said one device is exposed, said pieces cut from said one device being collected in a hopper;

(g) hydrolyzing each said fuze with a caustic solution heated above room temperature to remove and deactivate energetic material contained therein while spraying said exposed second chamber of said one device with a caustic solution;

(h) periodically cutting away another piece of said one device while spraying said exposed second chamber thereof with said caustic solution until said one device is fully cut into a plurality of pieces; and (i) positioning another one of said devices in the airlock having the atmosphere consisting substantially of nitrogen and repeat steps (b)–(i) until all of said devices have been decontaminated.

10. The method according to claim 9, wherein after said step (h) and before said step (i) further comprising the steps of:

selectively depositing said pieces in a queue of containers; and advancing said containers through a channel.

11. The method according to claim 10 further comprising the step of:

directing fresh caustic solution down said channel to cause flow from a first to last container to facilitate hydrolyzation.

12. The method according to claim 11 wherein said caustic solution is sodium hydroxide.

* * * * *